US012426689B2

(12) United States Patent
Venolia et al.

(10) Patent No.: US 12,426,689 B2
(45) Date of Patent: Sep. 30, 2025

(54) TOOLKIT AND METHOD FOR EMBEDDING FLAT PADDED EARRING POSTS INTO POLYMER CLAY JEWELRY

(71) Applicants: Scarlet Jeanena Venolia, Kailua, HI (US); Gina Danielle Venolia, Kailua, HI (US)

(72) Inventors: Scarlet Jeanena Venolia, Kailua, HI (US); Gina Danielle Venolia, Kailua, HI (US)

( * ) Notice: Subject to any disclaimer, the term of this patent is extended or adjusted under 35 U.S.C. 154(b) by 0 days.

(21) Appl. No.: 19/008,133

(22) Filed: Jan. 2, 2025

(65) Prior Publication Data

US 2025/0213014 A1 Jul. 3, 2025

Related U.S. Application Data

(60) Provisional application No. 63/617,075, filed on Jan. 2, 2024.

(51) Int. Cl.
*A44C 7/00* (2006.01)

(52) U.S. Cl.
CPC ..... *A44C 7/003* (2013.01)

(58) Field of Classification Search
CPC ..... A44C 7/00; A44C 27/00; Y10T 29/4959
See application file for complete search history.

(56) References Cited

U.S. PATENT DOCUMENTS

| | | | |
|---|---|---|---|
| 5,524,457 | A | 6/1996 | Dunham |
| 2007/0022779 | A1 | 2/2007 | Christians |

FOREIGN PATENT DOCUMENTS

| | | | |
|---|---|---|---|
| KR | 870003602 | Y1 | 10/1987 |
| KR | 20020000589 | A | 1/2002 |
| KR | 100482655 | B1 | 4/2005 |
| KR | 101873705 | B1 | 7/2018 |
| KR | 101951920 | B1 | 2/2019 |

OTHER PUBLICATIONS

Clay Impress, Screengrabs from Youtube Video titled: "The Best Way to Add Earring Posts to Polmer Clay Earrings", Dec. 30, 2023, <https://www.youtube.com/watch?v=AtXsRIn4dbY>, pp. 1-7 (Year: 2023).*

Dafenchi, "DAFENCHI Earring Post Embedder Tool for Polymer Clay Earrings, Clay Earring Post Embedding Tool, 3mm-8mm Earring Post Embeddered Kit for Clay Jewelry Making", Jul. 26, 2024, <https://www.amazon.com/DAFENCHI-Embedder-Earrings-Embedding-Embeddered/dp/B0DB7JG9FP>, pp. 1-4 (Year: 2024).*

(Continued)

*Primary Examiner* — Michael W Hotchkiss
(74) *Attorney, Agent, or Firm* — Keri Ann K.S. Krzykowski; Martin E. Hsia

(57) ABSTRACT

The present invention provides tools and a method for securely affixing flat padded earring posts onto cured polymer clay earrings. The tools include thickness guides, a disk-cutting tool, a dome-forming tool, and an alignment tool, enabling consistent and professional jewelry creation. The method eliminates the challenges associated with traditional adhesives, providing a more durable and polished finish suitable for jewelry crafting in various contexts.

8 Claims, 4 Drawing Sheets

(56) References Cited

OTHER PUBLICATIONS

The Artisan Duck, "The Best Way To Add Earring Posts To Polymer Clay Studs", May 23, 2021, <https://theartisanduck.com/2021/05/23/the-best-way-to-add-earring-posts-to-polymer-clay-studs/>, pp. 1-10 (Year: 2021).*

Cults, "Polymer Clay Post Embedder Tools", Apr. 19, 2024, <https://cults3d.com/en/3d-model/tool/polymer-clay-post-embosser-tool>, pp. 1-3 (Year: 2024).*

Arias Design, "How Should You Secure Your Polymer Clay Earring Studs?", Feb. 15, 2022, <https://www.ariasdesignco.com/en-us/blogs/news/how-should-you-secure-your-polymer-clay-earring-studs?srsltid=AfmBOopNFJ1V3cHGTyWpdT5yiu7LeDuAtpnZq9UXrG7p7YwdjP8uVpTe>, pp. 1-3 (Year: 2022).*

The Blue Bottle Tree, Screengrabs from the YouTube Video titled "Polymer clay earring backs without glue", Mar. 24, 2019, <https://www.youtube.com/watch?v=9wW415G13xE> (Year: 2019).*

The Blue Bottle Tree, "Securing Polymer Clay Earring Post Backs—What's the best way?", Mar. 24, 2019, pp. 6-7, <https://thebluebottletree.com/securing-polymer-clay-earring-post-backs-whats-the-best-way/> (Year: 2019).*

Phyllis Cahill, Tips & Tricks Embedding metal posts in polymer clay hoop earrings; https://polymerclayjourney.com/2022/03/07/embedding-metal-posts-in-polymer-clay-hoop-earring.

Keoker, Keoker Embedded Clay Cutters ( 16 shapes ), Oct. 28, 2024, https://www.keoker.net/products/keoker-embedded-clay-cutters-16-shapes.

* cited by examiner

TOOLKIT AND METHOD FOR EMBEDDING FLAT PADDED EARRING POSTS INTO POLYMER CLAY JEWELRY

TECHNICAL FIELD

The present invention relates to tools and methods used in jewelry crafting, particularly in attaching flat padded earring posts securely to polymer clay jewelry pieces.

BACKGROUND ART

In the field of earrings and similar jewelry, some means of attaching the jewelry to the ear is required. One common technique employs a short piece of straight wire, known in the art as an "earring post," protruding perpendicularly from the back of the jewelry, typically by about 12 mm. The wearer inserts the earring post into a pierced ear and then fits a small retaining device onto the end of the earring post, to prevent the earring from falling out of the ear. Earring posts can also be used for jewelry that is not earrings, sch as brooches.

One popular material for crafting earrings and similar jewelry is solid polymer clay. In its uncured state, solid polymer clay is a malleable putty, which an artisan can form into artistic shapes and decorate as desired. When cured, solid polymer clay becomes rigid.

Although there has been a need for at least 60 years, there is no satisfactory means of securely affixing a plain wire earring post directly to a solid polymer clay earring or other jewelry. When an artisan wishes to affix an earring post to a solid polymer clay earring, the present state of the art is to use an earring post that has previously been welded, soldered, integrally formed with, fused, or otherwise securely attached to a small metal disk. This assembly is known in the art as a "flat padded earring post," and is widely commercially available. The metal disk portion of the flat padded earring post is known in the art as a "flat pad," and is usually circular, with a pad diameter of 3-8 mm. The pad diameter is defined by the edge of the pad, which is referred to as the pad edge. Many techniques are known in the art for affixing the flat pad to the back of a polymer clay earring, including adhesives, coating with resin, coating with liquid polymer clay, and embedding with solid polymer clay. However, each of these approaches has notable limitations:

Adhesives such as a general purpose adhesive sold by Eclectic Products LLC under the trademark "E6000" often fail to create a strong bond between the flat pad and cured solid polymer clay due to both of their smooth, non-porous surfaces and possible chemical incompatibilities. These adhesives tend to detach over time, compromising durability and making them unsuitable for long-term use.

Cyanoacrylate adhesive, commonly referred to as "superglue", is used occasionally, but it is not ideal for long-term durability because it becomes brittle over time, especially under temperature changes, leading to risk of detachment and loss of the earring.

Epoxy resin or UV resin may be used but raise health concerns due to allergenic properties and potential skin irritation. Moreover, curing resin is time-consuming and requires a complex curing process.

Liquid polymer clay can be used to embed the flat pad onto the back of a cured or uncured solid polymer clay earring. The flat pad is placed on the back of the solid polymer clay earring, and then liquid polymer clay is pooled on the flat pad, coating the flat pad and a portion of the back of the solid polymer clay earring. The liquid polymer clay is then cured. This provides somewhat better adhesion in the short term, but it eventually peels off the back of the earring, making it neither an attractive nor a professional long-term solution. It can also be messy and difficult to achieve a professional result. Additionally, liquid polymer clay is much more expensive than solid polymer clay.

Embedding the flat pad in solid polymer clay that has been cured to join with the polymer clay earring is a more reliable but impractical way to affix flat padded earring posts. In one common method, the flat pad is placed on the back of the cured solid polymer clay earring, a small amount of uncured polymer clay impaled onto the earring post and then smoothed over the flat pad and blended onto the back of the cured solid polymer clay earring by hand, and finally the entire assembly is cured. While effective, it is labor-intensive and requires high degrees of skill and manual dexterity to achieve a professional finish consistently.

Notably, embedding the flat pad in solid polymer clay that has been cured to join with the polymer clay earring is considered the most durable method. Despite its effectiveness and the difficulties of doing it by hand, and the many decades that polymer clay has been widely available and used for jewelry crafting (since 1966), no specialized tools are available to facilitate the embedding process. As a result, artisans must rely on improvised techniques that require considerable skill and often result in inconsistent finishes.

https://polymerclayjourney.com/2022/03/07/embedding-metal-posts-in-polymer-clay-hoop-earrings/visited Oct. 29, 2024, by Cahill, discloses embedding posts in baked polymer clay earrings by inserting a wire with a hook, and then filling the hole with a past made of clay and liquid clay.

https://www.keoker.net/products/keoker-embedded-clay-cutters-16-shapes, visited Oct. 29, 2024, by Keoker, discloses shapes for cutting clay for earrings.

Korea patent application publication KR 101873705 B1 discloses an earring with a pin connection structure using laser welding.

Korea patent application publication KR 870003602 Y1 discloses an earring apparatus for an injection molded earring using an elastic rubber tube inserted into an insertion hole.

Korea patent application publication KR 20020000589 A discloses a coupling method for personal ornaments by rotating molds and injecting molten lead.

Korea patent application publication KR 101951920 B1 discloses a process for preparation of a ceramic earring clutch usable on both sides by inputting ceramic power into a mold and then installing a pin after a secondary firing.

Korea patent application publication KR 100482655 B1 discloses a method for combining a pin and a pendant using welding.

U.S. Pat. No. 5,524,457 to Dunham discloses an earring having a thin, flat, elliptical shaped base with a mounting at the top and a protrusion at the back of the bottom of the base to prevent an earring clipped on from falling off.

US Patent Publication 2007/0022779 A1 to Christians discloses an earring clutch finding including a body portion formed from a deformable material for protecting neck tissue that receives and releasably receives a post portion of an earring and is closed at an end distal to the earring.

Accordingly, it is an object of the present invention to provide a process and tools that simplify and make practical embedding flat pads in solid polymer clay, with the solid polymer clay being joined with the polymer clay earring, and then curing the assembled solid polymer clay and polymer clay earring, ensuring a rapid, secure, consistent, and professional result. The invention seeks to overcome the limitations of existing techniques and make the embedding process accessible to all artisans, regardless of their skill level.

DISCLOSURE OF THE INVENTION

The present invention provides specialized tools for affixing flat padded earring posts onto cured solid polymer clay earrings by embedding the flat pad in a flawlessly smooth dome of uncured solid polymer clay that elegantly encapsulates the flat padded earring post and provides a durable and professional finish, effectively addressing the limitations of existing methods, such as poor adhesion, messiness, and inconsistent finishes. The invention comprises a set of tools—including thickness guides, a tool for cutting a disk of uncured solid polymer clay, a tool for forming the disk into a dome that encases the flat pad, and a preferred alignment tool, which in combination streamline and standardize the embedding process. As used in this patent, the term "dome" is not restricted to a shape that has a circular base and a curved cross section, such as a hemisphere, but also includes shapes with an elliptical, polygonal, or irregularly shaped base, that also extend upwards to form a volume, and need not be symmetrical. Thus, the dome that is formed by the dome-forming tool may be of any shape, as determined by functional, aesthetic, and other considerations. The invention's step-by-step system eliminates the variability of expertise, ensuring consistent, high-quality results.

Similarly, as used in this patent, when referring to a disk of uncured solid polymer clay, the term "disk" is not restricted to a shape that is circular, but also includes shapes that are elliptical, polygonal or irregular.

The thickness guides ensure that the uncured solid polymer clay is of consistent specified thickness, preferably 1.5 mm, the disk-cutting tool produces a disk of uncured solid polymer clay having a precise volume, and the dome-forming tool has a body having a dome-forming void that transforms the disk into a smooth dome of uncured solid polymer clay over the flat pad. The alignment tool ensures proper placement of the flat padded earring post, resulting in consistent, professional-quality jewelry.

The invention comprises a process for embedding a flat padded earring post onto a cured polymer clay earring, where the flat padded earring post has a flat pad having a pad diameter and a pad edge, and an earring post attached to said flat pad. The process comprises positioning the flat pad on the cured polymer clay earring, and cutting a measured amount of uncured solid polymer clay into a disk of uncured solid polymer clay. The measured amount is a volume of clay sufficient to embed the flat pad and a portion of the earring post in a dome having an excess diameter greater than the pad diameter to form an embedding zone that contacts the polymer clay earring. Then impaling the disk of uncured solid polymer clay onto the earring post. Then pressing a dome-forming tool, having a dome-shaped void with a centered post hole that can receive the earring post and through which the earring post can project, together with the earring, over the impaled disk of uncured solid polymer clay. The earring post is received in the post hole, so that the dome-shaped void transforms the disk of uncured solid polymer clay into a dome of uncured solid polymer clay that embeds the flat pad and exceeds the diameter of the flat pad by the excess diameter to form the embedding zone that contacts the earring. The dome-shaped void has a volume equal to the measured amount plus the volume of the portion of the flat padded earring post embedded in the dome. Then curing the dome of uncured solid polymer clay and cured solid polymer clay earring, so that the flat pad is embedded in the cured solid polymer clay earring by said embedding zone.

This invention further comprises the process described above in which the pressing step is performed by pressing the dome-forming tool over the disk of uncured solid polymer clay.

Alternatively, this invention further comprises the process described above in which the pressing step is performed by pressing the cured polymer clay earring onto the flat pad and the dome-forming tool over the impaled disk of uncured solid polymer clay.

This invention further comprises either of the above processes in which the disk of uncured solid polymer clay has a center mark, and the impaling step is performed by impaling said disk of uncured solid polymer clay onto said earring post through said center mark.

This invention further comprises either of the above processes, wherein the earring has a convex edge, and the positioning step is performed by positioning the flat pad a horizontal offset distance from the convex edge using an alignment tool. The alignment tool includes an alignment fence and an alignment pocket having a diameter equal to the pad diameter the horizontal offset distance from the closest point of the alignment fence. The positioning is performed by placing the alignment fence against the convex edge and placing the pad edge of the flat pad against said alignment pocket.

This invention further comprises either of the above processes, wherein the earring has a concave edge, and the positioning step is performed by positioning the flat pad a horizontal offset distance from the concave edge using an alignment tool. The alignment tool includes an alignment point and an alignment pocket having a diameter equal to the pad diameter the horizontal offset distance from the alignment point, and the positioning is performed by placing the alignment point against the concave edge and placing the pad edge of the flat pad against the alignment pocket.

This invention further comprises a disk-cutting tool comprising a cutting edge and a center marking point that cuts a measured amount of uncured solid polymer clay into a disk of uncured solid polymer clay having a center mark, in which the measured amount is a volume of clay sufficient to embed the flat pad and a portion of the earring post in a dome having an excess diameter greater than the pad diameter to form an embedding zone that contacts the polymer clay earring. The dome-forming tool has a dome-shaped void and a centered post hole for receiving the earring post and can be pressed over the disk of uncured solid polymer clay and against the clay earring, with the earring post being received in the post hole, to transform the disk of uncured solid polymer clay into a dome of uncured solid polymer clay that embeds the flat pad and exceeds the diameter of the flat pad by the excess diameter to form the embedding zone that contacts the earring. The dome-shaped void has a volume equal to the measured amount plus the volume of the portion of the flat padded earring post embedded in the dome of uncured solid polymer clay.

Preferably, the cutting edge is circular.

This invention further comprises a dome-forming tool comprising a body having a dome-shaped void and a centered post hole for receiving the earring post, so that the centered post hole can receive the earring post and the earring post can project through the post hole. The dome-shaped void has a volume equal to a measured amount of clay sufficient to embed the flat pad and a portion of the earring post in a dome having an excess diameter greater than the pad diameter to form an embedding zone that contacts the polymer clay earring plus the volume of the portion of the flat padded earring post embedded in the dome of uncured solid polymer clay.

Pressing the dome-forming tool over a disk of uncured solid polymer clay impaled over the earring post having the measured amount, against said clay earring, so that the earring post is received in the post hole, transforms the disk of uncured solid polymer clay into a dome of uncured solid polymer clay that embeds the flat pad and exceeds the diameter of the flat pad by the excess diameter to form the embedding zone that contacts the earring.

This invention further comprises an alignment tool comprising a straight alignment fence on a bottom surface against which a convex edge of the earring can be positioned, an alignment pocket with a diameter equal to the pad diameter a horizontal offset distance from the closest portion of the alignment fence; and an alignment point the horizontal offset distance from the alignment pocket on a top surface.

This invention makes the embedding process faster, easier, reduces reliance on skill and manual dexterity, reduces user error, and provides consistent, durable, and polished results that surpass those achieved with traditional adhesives, resin coatings, or manual embedding methods. Thus, the present invention enables more artisans to use embedding by overcoming limitations of skill or manual dexterity. Furthermore, it allows artisans to produce their products more quickly, and so more economically.

The tools of the present invention are available in several different sizes, each designed specifically for use with flat pads ranging from 3 mm to 8 mm. Each disk-cutting tool and dome-forming tool is crafted to create the perfectly-sized dome of uncured solid polymer clay that securely embeds the flat pad while using the amount of uncured solid polymer clay necessary to avoid excess, which would result in uncured polymer clay squeezing out beyond the bounds of the dome shape, and also to avoid insufficiency, which would result in a dome with portions missing. Because different sizes of uncured solid polymer clay domes are required, each alignment tool, disk-cutting tool, and dome-forming tool is uniquely designed to work with a specific size of flat pad. This ensures that each size variation of the tools delivers consistent and professional results.

It should also be noted that the versions of the tools shown in the accompanying drawings represent the presently preferred embodiment of the invention. The handles of each tool (including the alignment tool, thickness guides, disk-cutting tool, and dome-forming tool) are depicted in a particular design, but this should not be interpreted as a limitation. For example, the handles are depicted as having hexagonal cross sections, to prevent rolling, but the handles are not the functional components of the present invention, and their design may be varied as desired.

Additionally, the invention may include versions where multiple disk-cutting tools and/or dome-forming tools of different sizes are integrated into a single body, allowing artisans to work with multiple sizes using a single tool. The variations disclosed above show the flexibility of the present invention and are intended to demonstrate the spirit of the invention, rather than to impose limitations.

Additionally, in some embodiments, each tool handle may feature a circular recess designed to help artisans determine if the flat pad matches the tool size. This recess allows artisans to place the flat pad into the recess to confirm compatibility, avoiding the need for separate measuring tools. If the flat pad fits snugly, the tool is suitable for use with that flat padded earring post. This feature is provided as an optional convenience and is not required for the basic operation of the invention, nor does it limit the scope of the claims.

BEST MODE FOR CARRYING OUT THE INVENTION

The presently preferred best mode for practicing the present invention is illustrated by way of example in FIGS. 1 to 6.

Figure 1:
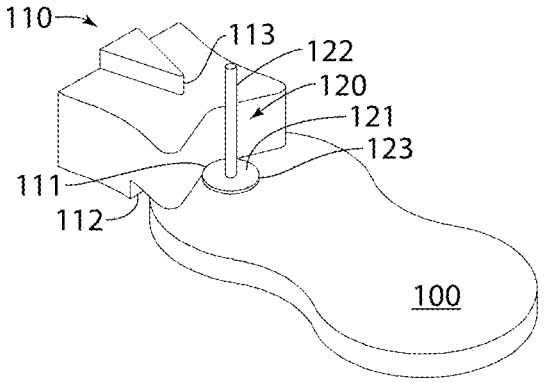
FIG. 1 is a perspective view of the alignment tool being used to position the flat padded earring post on the back of a cured solid polymer clay earring, set off from a convex edge of the earring.
Figure 1A:
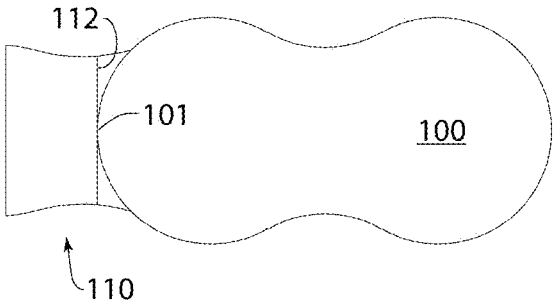
FIG. 1A is a plan view from the bottom of the same configuration as FIG. 1.

Referring to FIG. 1, shown is a cured solid polymer clay earring 100, a flat padded earring post 120, consisting of a flat pad 121 attached to an earring post 122 having a pad edge 123 that defines the pad diameter, and a preferred alignment tool 110 having an alignment pocket 111 a horizontal offset distance from the closest portion of a substantially straight alignment fence 112 on a bottom surface, and an alignment point 113 the same horizontal offset distance from the alignment pocket 111 on a top surface. Preferably, the alignment tool is used to offset the flat pad 121 and earring post 122 an appropriate distance away from the edge of the polymer clay earring 100, which edge could be convex or concave, to prevent the dome of uncured solid polymer clay 500 (see below) from extending beyond the earring's edge (although manual positioning could be used instead, if desired). Preferably, the alignment pocket 111 has a pocket diameter approximately equal to the diameter of the flat pad 121, so that the alignment pocket 111 can snugly receive the flat pad 121, and the pad edge abuts against the alignment pocket. For offsetting from a convex edge of the earring by the offset distance, the alignment fence 112 of the alignment tool 110 is placed against the convex edge 101 (as shown in FIG. 1A) of the cured solid polymer clay earring 100, and the pad edge 123 is then placed against the alignment pocket 111. Preferably, the polymer clay earring 100 is cured before embedding the flat padded earring post 120 to avoid distortion during the embedding process. The flat pad 121 may optionally be temporarily attached to the cured solid polymer clay earring 100 by means of a small amount of cyanoacrylate glue or similar (not shown).

Referring to FIG. 1A, the same configuration of parts is shown from below to make evident the contact between the convex edge 101 of the cured solid polymer clay earring 100 and the alignment fence 112.

Figure 2:
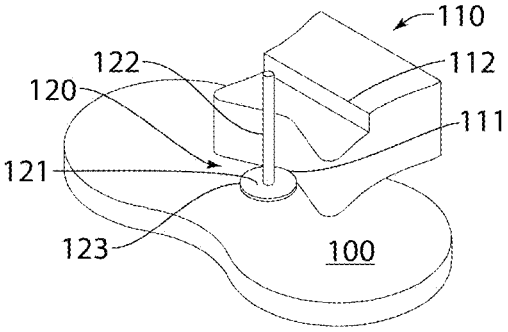
FIG. 2 is a perspective view of the alignment tool being used to position the flat padded earring post on the back of a cured solid polymer clay earring, set off from a concave edge.
Figure 2A:
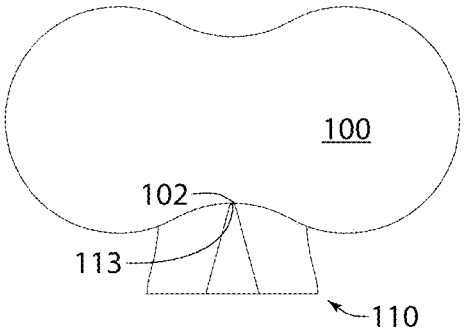
FIG. 2A is a plan view from the bottom of the same configuration as FIG. 2.

Referring to FIG. 2, shown is a cured solid polymer clay earring 100, a flat padded earring post 120, and the alignment tool 110, which is inverted from the orientation shown in FIG. 1. The alignment point 113 of the alignment tool 110 is placed against a concave edge 102 (as shown in FIG. 2A) of the cured solid polymer clay earring 100. The edge of the flat pad 121 is then placed against the alignment pocket 111.

Referring to FIG. 2A, the same configuration of parts is shown from below to make evident the contact between the concave edge 102 of the cured solid polymer clay earring 100 and the alignment point 113.

Figure 3:
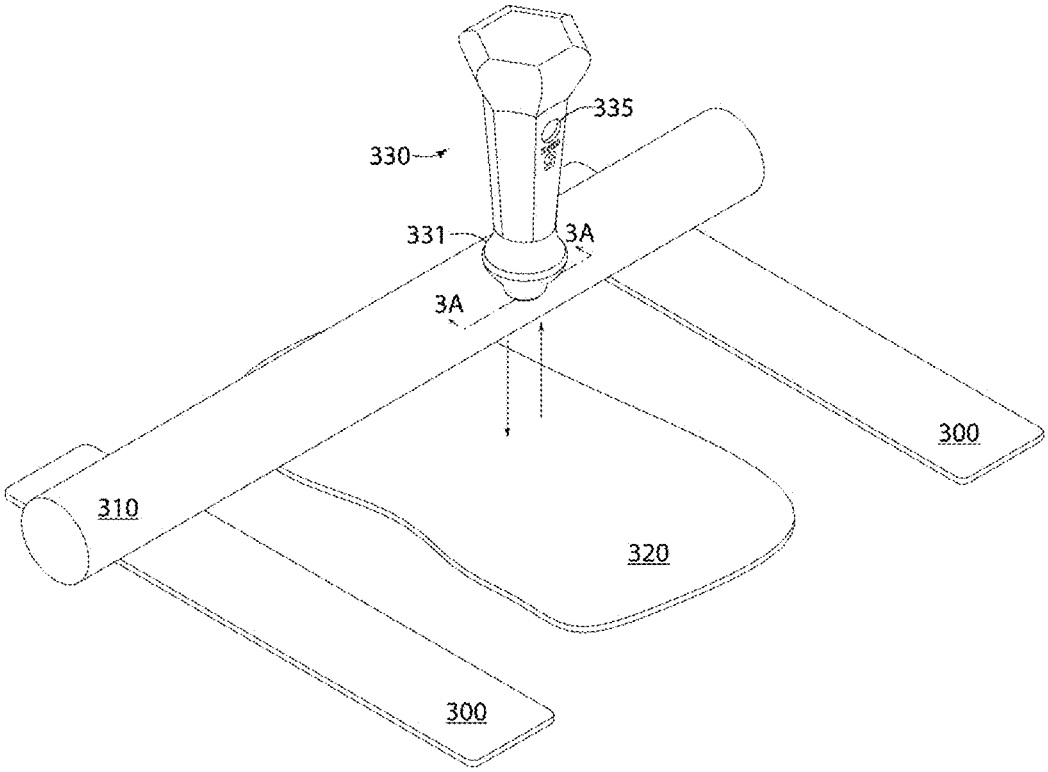
FIG. 3 is a perspective view (not to scale) showing a quantity of uncured solid polymer clay that has been rolled out to a precise thickness using a roller and thickness guides and applying the disk-cutting tool to cut and mark the uncured solid polymer clay.

Referring to FIG. 3, shown is a quantity of uncured solid polymer clay 320, having been rolled to a consistent thickness of the thickness guides 300 using a roller 310, as is familiar to a person of ordinary skill in the art, that is, an artisan. A disk-cutting tool 330 is then pressed firmly into the uncured solid polymer clay 320, by means of the ergonomic grip 331, and then removed. Optionally, the disk-cutting tool 330 could have a non-stick coating, or a release agent such as cornstarch, water or dimethicone (sold under the trademark "Armor All") may be used on the disk-cutting tool 330 to prevent the uncured solid polymer clay 320 from sticking to it.

The disk-cutting tool 330 may include a measuring recess 335, which allows the artisan to determine if the flat pad 121 is of the size for which the embedding tool is designed, as described below. This feature is provided as an optional convenience feature and does not affect the core functionality of the invention. The inclusion of this feature allows artisans to select the correctly sized tools by simply placing the flat pad 121 into the measuring recess 335. This feature is not intended to limit the scope of the invention, and alternative versions may or may not include this optional measuring feature.

Figure 3A:
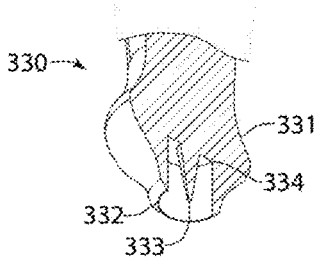
FIG. 3A is a sectional perspective view of the end of the disk-cutting tool along the line 3A-3A of FIG. 3, showing the portions that cut and mark the uncured solid polymer clay.
Figure 3B:
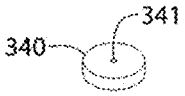
FIG. 3B is perspective view of the disk of uncured solid polymer clay that results from applying the disk-cutting tool to the uncured solid polymer clay.

Referring to FIG. 3A, shown is a sectional view of the portion of the disk-cutting tool 330 that acts on the uncured solid polymer clay 320. The cutting edge 332 forms a circular cut that creates a disk of uncured solid polymer clay 340 (see FIG. 3B) and the center-marking point 333 forms a preferred center mark 341 (see FIG. 3B) in the surface of the disk of uncured solid polymer clay 320. The circular cutting edge 332 and the center marking point 333 define a cavity 334. In an alternative embodiment, the preferred center-marking point 333 pierces completely through the disk of uncured polymer clay 320. An ergonomic grip 331 provides a means of pressing the disk-cutting tool 330 into the uncured solid polymer clay 320 with sufficient force to cut out the disk of uncured solid polymer clay 340 as seen in FIG. 3B. The cavity 334 of the disk-cutting tool has a sufficiently greater height than the thickness of the uncured polymer clay 320 to avoid adversely affecting the cutting of the disk of solid polymer clay 340.

Referring to FIG. 3B, shown is the resulting disk of uncured solid polymer clay 340, including a preferred center mark 341 which was formed by the center marking point 333. Notably, the dimensions of the disk of uncured solid polymer clay 340 are determined only by the height of the thickness guides 300 and the diameter of the cutting edge 332 of the disk-cutting tool 330, therefore the volume of the disk of uncured solid polymer clay 340 is the height of the disk times the area of the circular surface of the disk.

The volume of the disk of uncured solid polymer clay 340 is preferably a measured amount obtained by selecting a cutting tool having the appropriate diameter of cutting edge 332, based on the diameter of the flat pad 121, to provide a sufficient excess diameter and attachment surface beyond the flat pad 121 after the dome has been formed, as described in more detail below.

Figure 4:
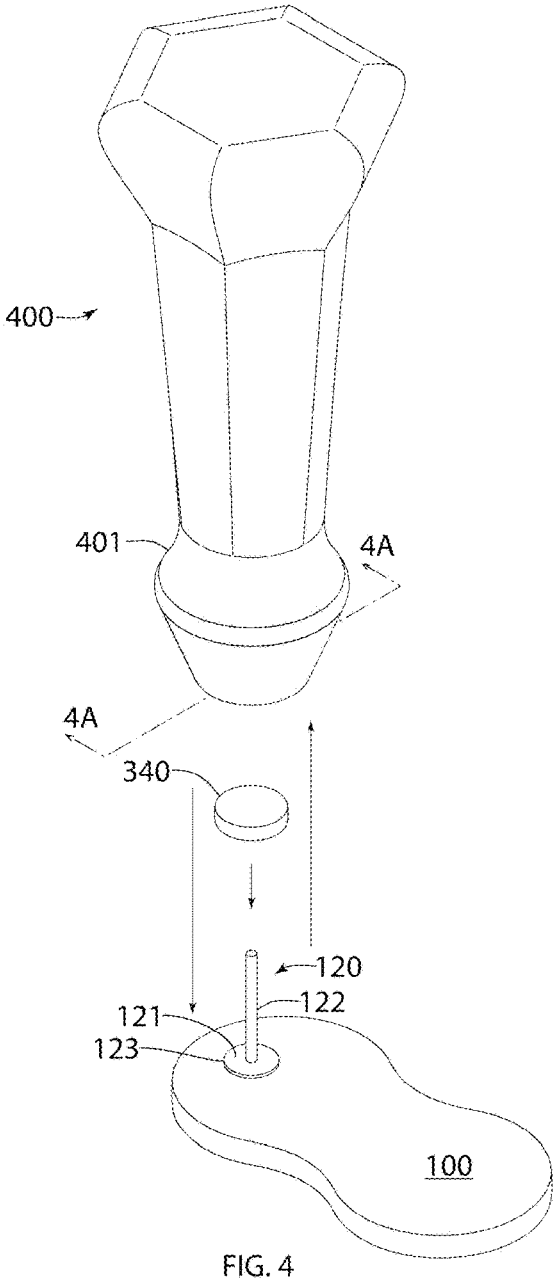
FIG. 4 is a perspective view of the dome-forming tool being applied to the disk of uncured solid polymer clay, the flat padded earring post, and the cured solid polymer clay earring.

Referring to FIG. 4, shown is the flat pad positioned on the earring 100 and the disk of uncured solid polymer clay 340 ready to be impaled onto the earring post 122, preferably through the center mark 341 (not visible in FIG. 4 because it is on the underside of the disk of uncured solid polymer clay 340). The post hole 403 of the dome-forming tool 400 is then fitted over the earring post 122, and the dome-forming tool 400 is pressed firmly over the disk of uncured solid polymer clay 340, by means of the ergonomic grip 401, and then removed. Preferably, the dome-forming tool 400 is also twisted during pressing, for a smooth dome-shaped appearance. Optionally, the dome-forming tool 400 could have a non-stick coating, or a release agent such as cornstarch, water or dimethicone (sold under the trademark "Armor All") may be used on the dome-forming tool 400 to prevent the disk of uncured solid polymer clay 340 from sticking to it.

Figure 4A:
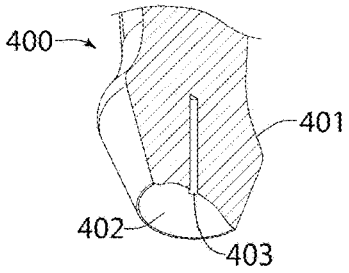
FIG. 4A is a sectional perspective view of the end of the dome-forming tool along the line 4A-4A of FIG. 4, showing the portion of the tool that forms a dome from the disk of uncured solid polymer clay.

Referring to FIG. 4A, shown is a sectional view of the portion of the dome-forming tool 400 that acts on the disk of uncured solid polymer clay 340. The centered post hole 403 receives the earring post 122, and therefore also centers the dome-forming tool 400 on the flat pad 121. The earring post 122 also projects through the post hole 403 allowing the dome forming tool 400 to press the disk of uncured polymer clay 340. The dome-shaped void 402 transforms the disk of uncured solid polymer clay 340 into a seamless dome of uncured solid polymer clay 500. The dome-shaped void 402 exceeds the diameter of the flat pad 121 by an excess diameter. An ergonomic grip 401 provides a means of pressing the dome-forming tool 400 into the disk of uncured solid polymer clay 340 with sufficient force to form the dome of uncured solid polymer clay 500 as seen in FIG. 5.

Optionally, the dome-shaped void 402 of the dome-forming tool could be formed in the dome-forming tool by using interchangeable inserts to create different dome sizes or shapes for various sizes of flat padded earring posts.

Figure 5:
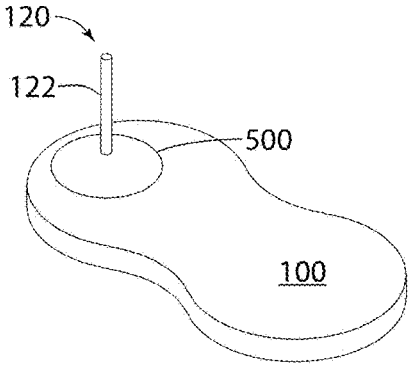
FIG. 5 is a perspective view that shows the results of applying the dome-forming tool, where the disk of uncured solid polymer clay has been formed into a dome shape which embeds the flat pad and a portion of the earring post, and also extends beyond the flat pad by an excess diameter, to form an annular (ring shaped) embedding zone.

Referring to FIG. 5, shown is the dome of uncured solid polymer clay 500 which now completely encases the flat pad 121 and extends beyond the flat pad 121 by the excess diameter, forming an annular (ring shaped) embedding zone 510, and the embedding zone directly contacts the clay earring 100, and thereby connects the dome of uncured solid polymer clay 500 (with the flat pad 121 embedded) to the cured solid polymer clay earring 100. When the assembly of the clay earring 100 and the dome of uncured solid polymer clay 500 is subsequently cured, the embedding zone 510 of the dome of uncured solid polymer clay 500 will be effectively fused with the cured solid polymer clay earring 100 into a continuous solid material, which thereby embeds the flat pad 121 into the cured solid polymer clay earring 100.

Figure 5A:
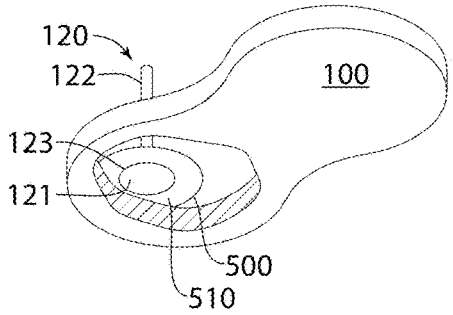
FIG. 5A is a perspective cutaway view from below of the same configuration as shown in FIG. 5, revealing that the dome extends beyond the flat pad to form an embedding zone that contacts the cured solid polymer clay earring.

Referring to FIG. 5A, shown is a perspective view of the assembly shown in FIG. 5 from below, with a cutout revealing the flat pad 121 embedded inside the dome of uncured solid polymer clay 500, with the embedding zone 510 directly contacting the cured solid polymer clay earring 100.

Notably, the volume of the dome-shaped void 402 approximately equals the sum of the volume of the disk of uncured solid polymer clay 340 and the volume of the portion of the flat padded earring post 120 that lies within the dome-shaped void 402, such that there is neither too much nor too little material to form the dome of uncured solid polymer clay 500, thus avoiding overflow of excess solid polymer clay, or insufficient uncured solid polymer clay to completely form the dome 500, when the dome-forming tool 400 is pressed on the disk of solid polymer clay 340 to form the dome 500.

Also, the dome-shaped void 402 must be shaped to provide a sufficiently large excess diameter to provide a sufficiently large embedding zone when the dome of uncured solid polymer clay 500 is formed. The dome-shaped void 402 has a volume equal to the measured volume plus the volume of the portion of the flat padded earring post embedded in the dome of uncured solid polymer clay 500.

Preferably, the following are preferred for the diameters of round flat pads and corresponding domes, to provide sufficiently large attachment areas:

| Diameter of flat pad | Diameter of dome |
|---|---|
| 3 mm | 8 mm |
| 4 mm | 9 mm |
| 5 mm | 10 mm |
| 6 mm | 11 mm |
| 8 mm | 12 mm |

Of course, different sizes of flat pad 121 require different sizes of disk-cutting tool 300 and dome forming tool 400.

Figure 6:
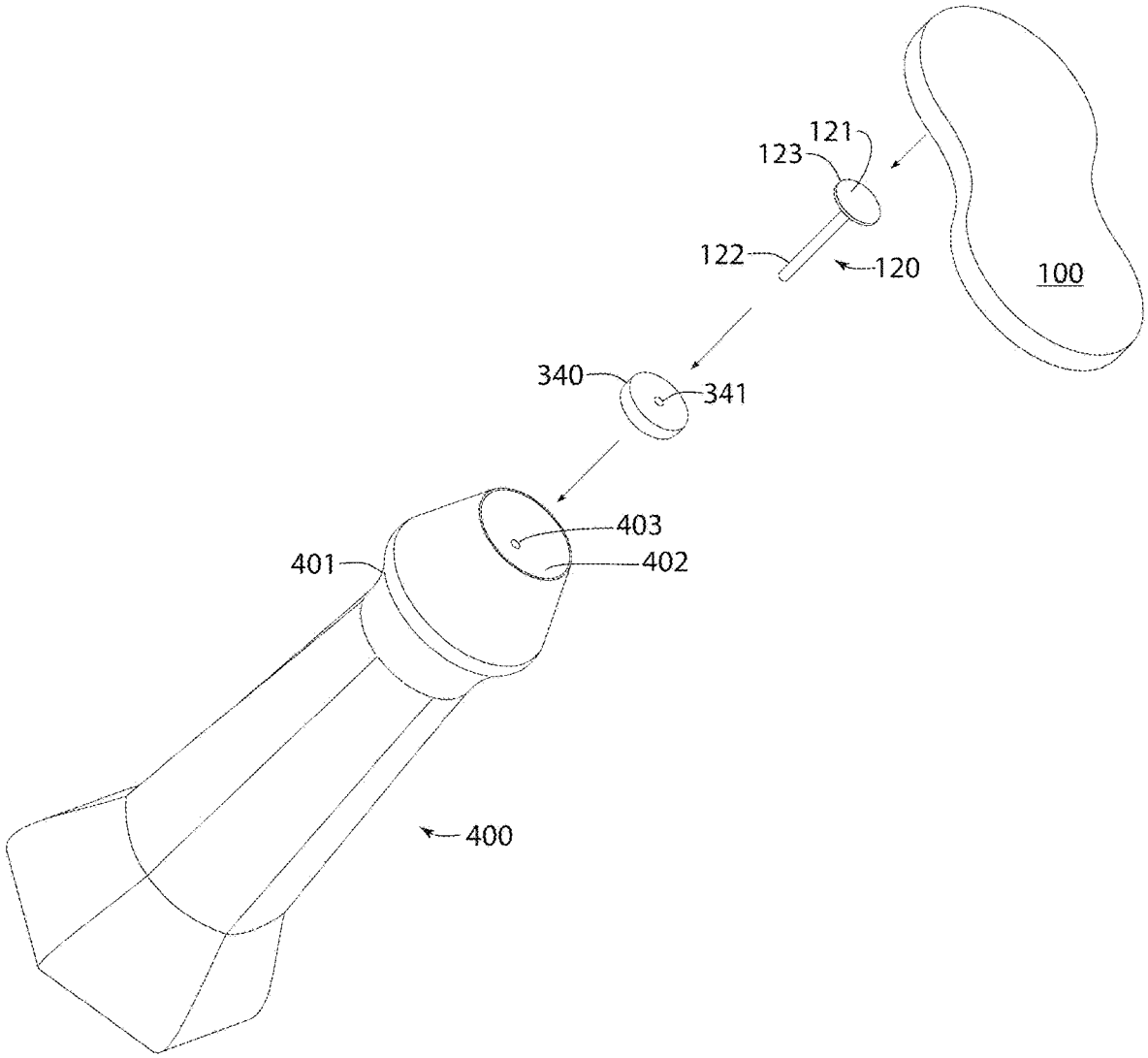
FIG. 6 is a perspective exploded view showing an alternative method of using the present invention, where the disk of uncured solid polymer clay is impaled on the earring post. This assembly is then inserted into the dome-forming tool, and then pressed to the cured solid polymer clay earring.

Referring to FIG. 6, shown is an alternative method of using the present invention. The disk of uncured solid polymer clay 340 is impaled onto the earring post 122, preferably through the center mark 341. The earring post 122 is then inserted into the post hole 403 of the dome-forming tool 400. Finally, the cured solid polymer clay earring 100 is pushed firmly onto this assembly, forming the disk of uncured solid polymer clay 340 into the dome of uncured solid polymer clay 500 as shown in FIG. 5.

This alternative method can be used in multiple ways, such as the dome-forming tool 400 may sit on a work surface with the dome-shaped void 402 facing up and the cured solid polymer clay earring 100 in the artisan's hand, or with the dome-forming tool 400 in one hand and the cured solid polymer clay earring 100 in the other hand.

Alternative methods of using the dome-forming tool 400 may be preferred and are appropriate when precise placement of the flat padded earring post 120 is not required. Additionally, uneven details on the front of the cured solid polymer clay earring 100 may prevent it from sitting flat on a work surface as shown in FIG. 4. Therefore, the artisan may prefer to hold both the cured solid polymer clay earring 100 and the dome-forming tool 400 each in one hand.

After the flat padded earring post 120 has been aligned, and embedded in and attached to the earring 100 by the embedding zone of the uncured solid polymer dome 500, as described above, the uncured solid polymer dome 500 and the polymer clay earring 100 are cured together, to complete the process.

To summarize, the invention provides embedding tools for attaching flat padded earring posts to cured solid polymer clay earrings and the like, comprising a combination of tools for preparing a measured amount of uncured solid polymer clay (which is equal to the volume as the dome-shaped void 402 in the dome-forming tool 400) into a disk of uncured solid polymer clay or similar shape (although equivalent methods that provide consistent and repeatable volume can also be used). The tools include a dome-forming tool for pressing the disk of uncured solid polymer clay into a dome shape that embeds the flat pad and forms an embedding zone, wherein the dome-forming tool includes variations in geometries and functional configurations to suit different aesthetic needs.

In more detail, thickness guides, a roller, and a disk-cutting tool are used to form a measured amount of uncured solid polymer clay into a disk shape having a volume of clay sufficient to embed the flat pad in a dome with an excess diameter to form an embedding zone.

The disk-cutting tool also marks the center of the disk of uncured solid polymer clay for accurate positioning of the flat padded earring post.

A dome-forming tool having a dome-shaped void presses the disk of uncured solid polymer clay into a dome embedding the flat padded earring post, without any excess uncured solid polymer clay or unsightly bubbles or holes, and also forms an embedding zone to attach the dome to the earring when they are both cured.

While the present invention has been disclosed in connection with the presently preferred best mode described herein, it should be understood that the best mode includes words of description and illustration, rather than words of limitation. There may be other embodiments which fall within this spirit and scope of the invention as defined by the claims. Accordingly, no limitations are to be implied or inferred in this invention except as specifically and as explicitly set forth in the claims.

INDUSTRIAL APPLICABILITY

The present invention is applicable whenever there is a need to securely and quickly attach a flat padded earring post to a cured solid polymer clay earring.

What is claimed is:

1. A process for embedding a flat padded earring post onto a cured polymer clay earring, wherein said flat padded earring post has a flat pad having a pad diameter and a pad edge, and an earring post attached to said flat pad, comprising:

positioning said flat pad on said cured polymer clay earring;

cutting a measured amount of uncured solid polymer clay into a disk of uncured solid polymer clay;

providing a dome-forming tool to press said disk of uncured solid polymer clay into a smooth domed shape, having a dome-shaped void with a centered post hole that can receive said earring post;

wherein said measured amount is a volume of clay sufficient to embed said flat pad and a portion of said earring post in a dome having an excess diameter greater than said pad diameter to form an embedding zone that contacts said polymer clay earring;

pressing said dome-forming tool over said earring post wherein said earring post is received in said post hole, whereby said dome-shaped void transforms said disk of uncured solid polymer clay into a dome of uncured solid polymer clay that embeds said flat pad and exceeds said diameter of said flat pad by said excess diameter to form said embedding zone that contacts said earring;

wherein said dome-shaped void has a volume equal to said measured amount plus the volume of the portion of the flat padded earring post embedded in said dome of uncured solid polymer clay; and curing said dome of uncured solid polymer clay and cured solid polymer clay earring, whereby said flat pad is embedded in said cured solid polymer clay earring by said embedding zone.

2. A process according to claim 1, wherein said disk of uncured solid polymer clay has a center mark.

3. A process according to claim 1, wherein said earring has a convex edge, wherein said positioning step is performed by positioning said flat pad a horizontal offset distance from said convex edge using an alignment tool that includes an alignment fence and an alignment pocket having a diameter equal to said pad diameter, said alignment pocket being said horizontal offset distance from the closest point of said alignment fence, by placing said alignment fence against said convex edge and placing said pad edge of said flat pad against said alignment pocket.

4. A process according to claim 1, wherein said earring has a concave edge, wherein said positioning step is performed by positioning said flat pad a horizontal offset distance from said concave edge using an alignment tool that includes an alignment point and an alignment pocket having a diameter equal to said pad diameter, said alignment pocket being said horizontal offset distance from said alignment point, by placing said alignment point against said concave edge and placing said pad edge of said flat pad against said alignment pocket.

5. A process according to claim 1, wherein said pressing step is performed by pressing said cured polymer clay earring onto said flat pad and said dome-forming tool over said disk of uncured solid polymer clay.

6. A process according to claim 5, wherein said cutting step further comprises adding a center mark.

7. A process according to claim 5, wherein said earring has a convex edge, wherein said positioning step is performed by positioning said flat pad a horizontal offset distance from said convex edge using an alignment tool that includes an alignment fence and an alignment pocket having a diameter equal to said pad diameter, said alignment pocket being said horizontal offset distance from the closest point of said alignment fence, by placing said alignment fence against said convex edge and placing said pad edge of said flat pad against said alignment pocket.

8. A process according to claim 5, wherein said earring has a concave edge, wherein said positioning step is performed by positioning said flat pad a horizontal offset distance from said concave edge using an alignment tool that includes an alignment point and an alignment pocket having a diameter equal to said pad diameter, said alignment pocket being said horizontal offset distance from said alignment point, by placing said alignment point against said concave edge and placing said pad edge of said flat pad against said alignment pocket.

* * * * *